US011385670B2

(12) United States Patent
Liao et al.

(10) Patent No.: US 11,385,670 B2
(45) Date of Patent: Jul. 12, 2022

(54) REFERENCE VOLTAGE GENERATING CIRCUIT AND LOW POWER CONSUMPTION SENSOR

(71) Applicant: National Yang Ming Chiao Tung University, Hsinchu (TW)

(72) Inventors: Yu-Te Liao, Hsinchu (TW); Cheng-Ze Shao, Miaoli County (TW); Shih-Che Kuo, Taoyuan (TW)

(73) Assignee: National Yang Ming Chiao Tung University, Hsinchu (TW)

( * ) Notice: Subject to any disclaimer, the term of this patent is extended or adjusted under 35 U.S.C. 154(b) by 0 days.

(21) Appl. No.: 17/324,601

(22) Filed: May 19, 2021

(65) Prior Publication Data

US 2022/0171419 A1 Jun. 2, 2022

(30) Foreign Application Priority Data

Dec. 1, 2020 (TW) ..... 109142145

(51) Int. Cl.
*G05F 1/46* (2006.01)
*G05F 3/26* (2006.01)
*G05F 1/567* (2006.01)

(52) U.S. Cl.
CPC ..... *G05F 3/267* (2013.01); *G05F 1/468* (2013.01); *G05F 1/567* (2013.01)

(58) Field of Classification Search
None
See application file for complete search history.

(56) References Cited

U.S. PATENT DOCUMENTS 8,432,214 B2 * 4/2013 Olmos ..... G01K 7/01 327/512
9,519,304 B1 * 12/2016 Far ..... G05F 3/08
10,037,047 B2 * 7/2018 Quelen ..... G05F 3/267
2021/0356982 A1 * 11/2021 Cheng ..... G05F 3/262

* cited by examiner

*Primary Examiner* — Jeffery S Zweizig
(74) *Attorney, Agent, or Firm* — Rabin & Berdo, P.C.

(57) ABSTRACT

A low-power CMOS reference voltage generating with enhanced power supply rejection ratio (PSRR) and fast start-up time is disclosed. The reference voltage generating is generated by the stacked diode-connected MOS transistors (SDMT) architecture to reduce the dependence on process, voltage and temperature. The self-biased and capacitor coupled architecture can shorten the start-up time without increasing power consumption and improve the bandwidth of the power supply rejection ratio. This design is implemented using a CMOS process, which can achieve stabilization time of 0.2 ms. Under the same power consumption, this design is 274 times better than a design without a start-up time enhancement. The power supply rejection ratio measured at 100 Hz is −73.5 dB. In the temperature range of −40 to 130° C., the average temperature coefficient is 62 ppm/° C.

19 Claims, 4 Drawing Sheets

REFERENCE VOLTAGE GENERATING CIRCUIT AND LOW POWER CONSUMPTION SENSOR

CROSS-REFERENCE TO RELATED APPLICATION

This application claims the benefit of Taiwan Patent Application No. 109142145, filed on Dec. 1, 2020, in the Taiwan Intellectual Property Office, the disclosure of which is incorporated herein in its entirety by reference.

BACKGROUND

1. Technical Field

The present disclosure relates to a reference voltage generating circuit, in particular to a self-biased and capacitive-coupled reference voltage generating circuit that can be started-up quickly and has a high power supply rejection ratio (PSRR), and a sensor using the reference voltage generating circuit.

2. Description of the Related Art

Reference voltage generating circuits are widely used in various electronic systems to generate voltages which are independent to the process, power supply, and temperature changes, so as to meet applications of more advanced battery-less Internet of Things (IoT) devices, such as patch-type sensing systems and biomedical implants. Therefore, designing a low-power consumption, small area and calibration-free reference voltage generating circuit has become a new requirement and challenge. In addition to the requirements of temperature, process, and voltage stability, low-power circuit design often results in long start-up time and reduced power supply rejection ratio. These two design indicators (i.e. start-up time and PSRR) are also stringent tests for circuit design.

With the increasing demand for self-powered sensing chips, many papers have proposed various temperature-stable voltage reference generating circuits with power consumption in the micro-Watt (μW) level, which mainly include sub-bandgap reference voltage generating circuit architecture and complementary metal-oxide-semiconductor field effect transistor (CMOS) architecture.

Compared with the CMOS architecture, the sub-bandgap reference voltage generating circuit generally has larger power consumption and chip area, but has a better temperature coefficient (TC). The sub-bandgap reference voltage generating circuit which uses the switch to switch the bipolar junction transistor (BJT) can reduce the static power consumption to tens of nano-Watt (nW), but the complex controlling and clock circuit and the capacitors which are used for suppressing noise will significantly increase the chip area. In addition, the hybrid reference voltage generating circuit which uses a leakage current has characteristics of CMOS and BJT, while achieving the purpose of low-power consumption and low temperature coefficient, but the leakage current of the parasitic diode narrows the temperature range, thus it cannot operate at high temperatures and low temperature environment. Furthermore, the hybrid reference voltage generating circuit uses a zero threshold voltage transistor, which increases the cost of manufacturing chips and makes it more difficult to control process variation.

Although the above designs can achieve low power consumption reference voltage generating circuits, the key problem of the actual design is that low power consumption designs will also lead to a decrease in bandwidth, causing serious problems in suppressing the interference coupling between 50-60 Hz frequency bandwidth. Regarding the current design of the power supply rejection ratio (PSRR) of the reference voltage generating circuit which power consumption is less than 100 nano-Watt, the bandwidth of the current design (i.e. the bandwidth which PSRR is less than −50 db) is limited.

Another problem is that low power consumption operation (less than 100 nW operation) causes a large impedance value between the power supply and the output of the reference voltage generating circuit, which makes the required time up to tens of milliseconds or more for voltage switching. It induces problems in circuits that require fast switching or response, such as vibration energy harvesting circuits and duty-cycling communication circuits.

SUMMARY

It can be understood from the above description that the technical problem to be solved is to provide a reference voltage generating circuit with characteristics such as low temperature variation, low process variation, voltage stability, low power consumption, small area and calibration-free, and the reference voltage generating circuit needs to be able to improve the problems of long start-up time and reduced power supply rejection ratio caused by circuit design with low power consumption.

In order to solve the aforementioned conventional problems, an embodiment of the present disclosure provides a self-biased and capacitive-coupled reference voltage generating circuit, which comprises a current source circuit and a core circuit. An input terminal of the current source circuit is connected to a first feedback node, the voltage of the first feedback node is a reference voltage, and a plurality of output terminals of the current source circuit output current sources.

The core circuit comprises a first stacked diode-connected circuit and a second stacked diode-connected circuit. The first stacked diode-connected circuit has a first transistor with a diode-connected configuration and a second transistor having a conductive type same as that of the first transistor, a connection node of the first transistor and the second transistor outputs a threshold voltage difference value, an input terminal of the first stacked diode-connected circuit, the gates of the first transistor and the second transistor are connected to one of the output terminals of the current source circuit, and an output terminal of the second transistor is connected to a ground terminal.

The second stacked diode-connected circuit has a third transistor with a diode-connected configuration and a fourth transistor having a conductive type same as that of the third transistor, a connection node of the third transistor and the fourth transistor outputs a reference voltage, an input terminal of the second stacked diode-connected circuit, the gates of the third and fourth transistors are connected to another one of the output terminals of the current source circuit, there is a second feedback node formed between an output terminal of the fourth transistor and the input terminal of the current source circuit.

According to an embodiment of the present disclosure, the current source circuit comprises a cascode current mirror circuit.

According to an embodiment of the present disclosure, the cascode current mirror circuit comprises a first output circuit, a second output circuit, and an input circuit. The first output circuit comprises a first P-type transistor and a second P-type transistor, and a source of the first P-type transistor is connected to an operating voltage. The second P-type transistor is serially connected to the first P-type transistor, and the second P-type transistor outputs a first current source of the current sources to the first stacked diode-connected circuit.

The second output circuit comprises a third P-type transistor and a fourth P-type transistor, and a source of the third P-type transistor is connected to the operating voltage. The fourth P-type transistor is serially connected to the third P-type transistor, and the fourth P-type transistor outputs a second current source of the current sources to the second stacked diode-connected circuit, and a gate of the fourth P-type transistor is connected to a gate of the second P-type transistor.

The input circuit comprises a fifth P-type transistor, a sixth P-type transistor, a fifth N-type transistor and a sixth N-type transistor. a drain of the fifth P-type transistor is connected to the operating voltage, and a gate of the fifth P-type transistor is connected to a gate of the third P-type transistor and connected to a gate of the first P-type transistor.

A gate of the sixth P-type transistor is connected to a second feedback node, and a serial connection node of the sixth P-type transistor and the fifth P-type transistor is connected to the gate of the fifth P-type transistor.

A gate of the fifth N-type transistor is connected to the gate of the fourth transistor.

A gate of the sixth N-type transistor is connected to the first feedback node, and a serial connection node of the sixth N-type transistor and the fifth N-type transistor is connected to a third feedback node, and the third feedback node is connected to the gates of the fourth P-type transistor and the second P-type transistor, and a source of the sixth N-type transistor is connected to the ground terminal.

According to an embodiment of the present disclosure, the reference voltage generating circuit further comprises a first coupling capacitor and a second coupling capacitor. Two terminals of the first coupling capacitor are coupled between the gate of the fifth N-type transistor and the serial connection node of the fifth N-type transistor and the sixth P-type transistor.

A terminal of the second coupling capacitor is coupled to the serial connection node of the fifth N-type transistor and the sixth P-type transistor, and another terminal of the second coupling capacitor is coupled between the first output circuit and the first stacked diode-connected circuit.

According to an embodiment of the present disclosure, the reference voltage generating circuit further comprises a third coupling capacitor, a terminal of the third coupling capacitor is coupled to the gates of the fourth P-type transistor and the second P-type transistor, and another terminal of the third coupling capacitor is coupled to the ground terminal, and the high voltage terminal of the third coupling capacitor is coupled to the third feedback node, and a high voltage terminal of the two terminals of the third coupling capacitor is connected to a serial connection node of the sixth N-type transistor and the fifth N-type transistor through the third feedback node.

According to an embodiment of the present disclosure, a capacitance value of the second coupling capacitor is greater than a capacitance value of the first coupling capacitor.

According to an embodiment of the present disclosure, a size and a threshold voltage of the third transistor are respectively different from those of the fourth transistor.

According to an embodiment of the present disclosure, the reference voltage generating circuit lacks of a bipolar junction transistor.

Based on the above purposes, an embodiment of the present disclosure also provide a reference voltage generating circuit with a stacked diode-connected architecture, which comprises a current source circuit, a first transistor and a second transistor. An input terminal of the current source circuit is connected to an operating voltage, and the current source circuit outputs a current source.

A drain of the first transistor is connected to an output terminal of the current source circuit. The second transistor is serially connected to the first transistor, and a source of the second transistor is connected to a ground terminal, the serial connection node of the second transistor and the first transistor outputs a reference voltage, and the gates of the second transistor and the first transistor are connected to the output terminal of the current source circuit, a thickness of a gate oxide layer of the first transistor is smaller than a thickness of a gate oxide layer of the second transistor.

According to an embodiment of the present disclosure, the first transistor and the second transistor are a same conductive type.

Based on the above purposes, an embodiment of the present disclosure also provides a low-power consumption sensor, which is suitable for battery-less Internet of Things (IoT) devices, and the low-power consumption sensor comprises one of the above-mentioned reference voltage generating circuits.

According to an embodiment of the present disclosure, the low-power consumption sensor is a patch-type sensor or a biomedical implanter.

As mentioned above, a self-biased and capacitive-coupled reference voltage generating circuit and a reference voltage generating circuit with stacked diode-connected architecture according to an embodiments of the present disclosure have the following advantages:

1. By using a reference voltage generating circuit with a stacked diode-connected architecture, the threshold voltage difference of two transistors can be used to improve the stability of temperature coefficient, and to reduce the influence of process variation and the sensitivity of power supply.

2. By using a reference voltage generating circuit with a stacked diode-connected architecture, it can increase the resistance of the current source and suppress the power interference between the operating voltage and the output reference voltage.

3. Since bipolar junction transistors are not used in the circuit architecture, power consumption and chip area can be effectively reduced.

4. By using a self-biased feedback loop, it can eliminate the additional power consumption and chip area of the conventional starting circuit, and also prevent the leakage current of the startup circuit from affecting the temperature performance of the circuit.

5. With the coupled capacitor, the start-up time can be shortened to 0.2 milliseconds, and the bandwidth can be extended to 100 Hz to suppress interference in the 50-60 Hz frequency band from the commercial power supply.

BRIEF DESCRIPTION OF THE DRAWINGS

In order to make the above and other purposes, features, advantages and embodiments of the present disclosure more obvious and understandable, the description of the accompanying drawings is as follows.

DETAILED DESCRIPTION

Hereinafter, at least one embodiment of the present disclosure will be described according to FIG. 1 to FIG. 4. The descriptions are not intended to limit the implementation of the present disclosure, but only examples of the present disclosure.

Figure 1:
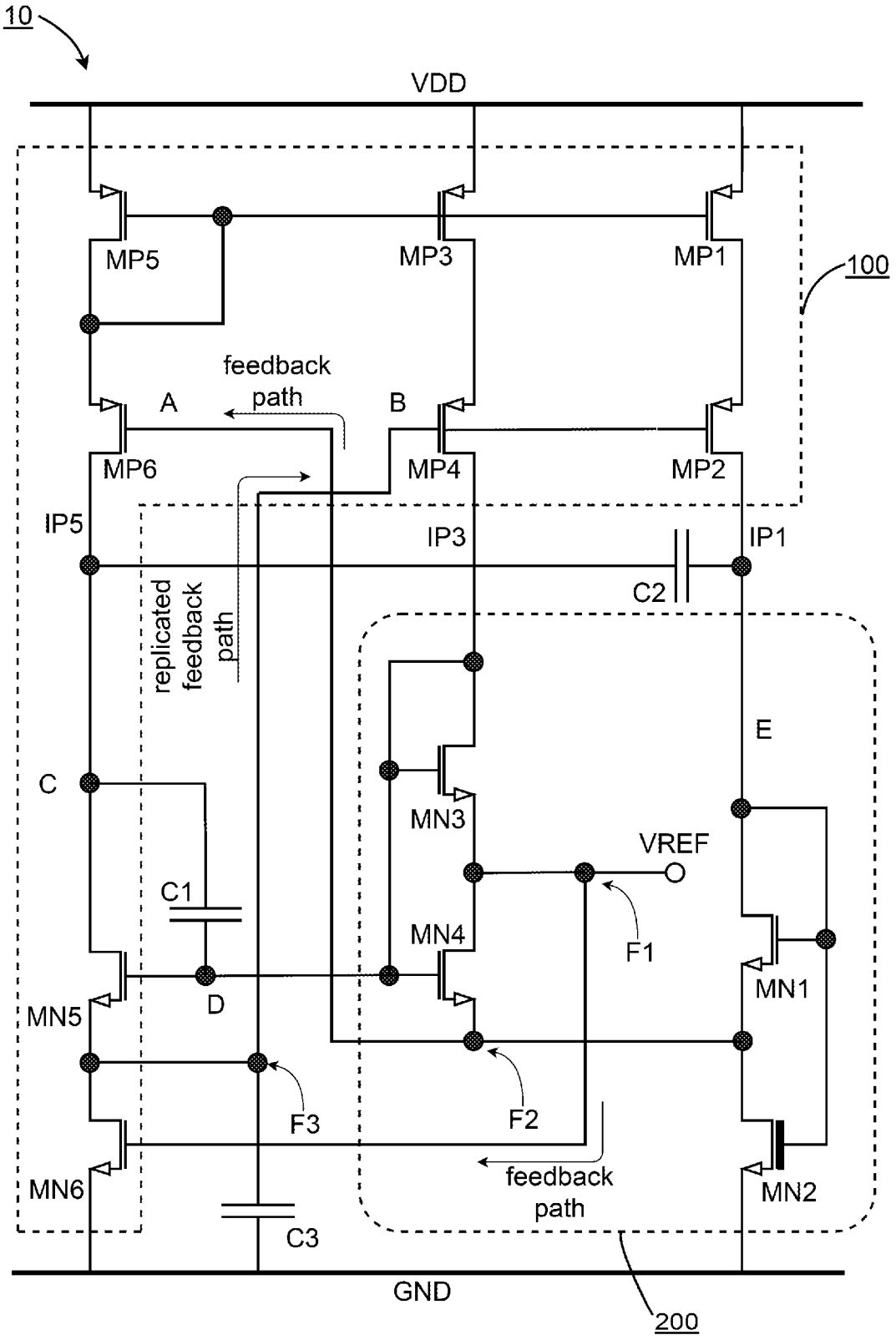
FIG. 1 is a schematic diagram of a self-biased and capacitive-coupled reference voltage generating circuit according to an embodiment of the present disclosure.

Refer to FIG. 1, which is a schematic diagram of a self-biased and capacitive-coupled reference voltage generating circuit according to an embodiment of the present disclosure. As shown in the drawings, the self-biased and capacitive-coupled reference voltage generating circuit 10 comprises a current source circuit 100 and a core circuit 200. An input terminal of the current source circuit 100 is connected to the first feedback node F1, the voltage of the first feedback node F1 is the reference voltage VREF, and output terminals of the current source circuit 100 outputs current sources (IP1, IP3, and IP5).

The core circuit 200 comprises a first stacked diode-connected circuit and a second stacked diode-connected circuit. The first stacked diode-connected circuit has a first transistor MN1 with a diode-connected configuration (representing a connection between the gate and the drain) and a second transistor MN2 having a conductive type same as that of the first transistor MN1 (for example, the conductive type of the two transistors MN1 and MN2 are N-type). The difference value of the threshold voltages is outputted by the connection node of the first transistor MN1 and the second transistor MN2. An input terminal of the first stacked diode-connected circuit (representing the drain of the first transistor MN1) and the gates of the first transistor MN1 and the second transistor MN2 are connected to the output terminal (representing the current source IP1) of the current source circuit 100. An output terminal of the second transistor MN2 (representing the source of the second transistor MN2) is connected to the ground terminal GND.

The second stacked diode-connected circuit has a third transistor MN3 with a diode-connected configuration (representing a connection between the gate and the drain) and a fourth transistor MN4 having a conductive type same as that of the third transistor MN3 (for example, the conductive type of the two transistors MN3 and MN4 are N-type). The reference voltage VREF is outputted by the connection node of the third transistors MN3 and the fourth transistor MN4. An input terminal of the second stacked diode-connected circuit (representing the drain of the third transistor MN3), the gates of the third transistor MN3 and the fourth transistor MN4 are connected to another output terminal of the current source circuit 100 (representing the current source IP3). There is a second feedback node F2 between an output terminal of the fourth transistor MN4 (representing the source of the fourth transistor MN4) and the input terminal of the current source circuit 100.

First, the first stacked diode-connected circuit disclosed above will be described in detail. The transistor current ($I_D$) equation operated in the subthreshold region is shown as equation (1):

$$I_D = \mu_n C_{ox}\left(\frac{W}{L}\right)V_T^2\exp\left(\frac{V_{GS}-V_{TH}}{mV_T}\right)\left(1-\exp\left(\frac{-V_{DS}}{V_T}\right)\right) \quad (1)$$

Where $\mu_n$ represents the carrier mobility of the N-type transistor, $C_{ox}$ is the gate oxide capacitance of the transistor, W and L are the channel width and the channel length of the transistor respectively, m is the slope parameter, $V_T$ is the thermal voltage, $V_{TH}$ is the threshold voltage of the transistor, $V_{GS}$ is the relative voltage difference between the gate and source of the transistor, and $V_{DS}$ is the relative voltage difference between the drain and source of the transistor.

Therefore, if the voltage outputted by the connection node of the first transistor MN1 and the second transistor MN2 is used as the reference voltage VREF', it can be expressed by the following equation (2):

$$V'_{REF} = \left(\frac{m_t}{m_b}V_{THb} - V_{THt}\right) + m_t V_T \ln\left(\frac{\mu_t C_{oxt} W_t L_b}{\mu_b C_{oxb} W_b L_t}\right) + \left(1-\frac{m_t}{m_b}\right)V_{GSb} \quad (2)$$

the parameter with the subscript t corresponds to the first transistor MN1, and the parameter with the subscript b corresponds to the second transistor MN2. For example, the first transistor MN1 may be a transistor whose gate oxide layer is thinner than that of the second transistor MN2.

In the above equation (2), the first term represents the part of the reference voltage that is inversely proportional to the absolute temperature (complementary-to-absolute-temperature, CTAT), which means that the reference voltage is adjusted by the difference value of the threshold voltages of the first transistor MN1 and the second transistor MN2.

Since the first transistor MN1 and the second transistor MN2 used are the same conductive type of transistors, the temperature dependence of the threshold voltage difference between the two transistors can be effectively reduced when the temperature of the operating environment is changed. Therefore, the temperature effect of the reference voltage is reduced. In addition, when the manufacturing process is changed, the threshold voltages of the first transistor MN1 and the second transistor MN2 are shifted in the same direction which the influence of the manufacturing process on the reference voltage can be reduced. The difference of the threshold voltages between the first transistor MN1 and the second transistor MN2 is only 29 mV in the three process ranges of fast (FF), typical (IT) and slow (SS) under the verification of simulation.

In the above equation (2), the second term represents the part of the reference voltage that is proportional to the absolute temperature (proportional-to-absolute-temperature, PTAT), which means that the reference voltage can be adjusted by the thermal voltage $V_T$. The parameters W and L respectively represent the size parameters of the transistor, that is, channel width and channel length.

In the above equation (2), the third term represents the slope parameter m related to the size of the first transistor MN1 and the second transistor MN2 in the reference voltage. The first-order linear compensation of temperature is achieved by using an appropriate transistor ratio. Therefore, this architecture can be operated stably in the temperature range of −40° C. to 130° C.

According to an embodiment of the present disclosure, the current source circuit 100 comprises a cascode current mirror circuit. By this architecture, a more stable current source IP5 can be generated at the first feedback node F1, and then the current sources IP3 and IP1 can be duplicated through the cascode current mirror circuit.

According to an embodiment of the present disclosure, the cascode current mirror circuit comprises a first output circuit, a second output circuit, and an input circuit. The first output circuit comprises a first P-type transistor MP1 and a second P-type transistor MP2. The source of the first P-type transistor MP1 is connected to the operating voltage VDD, and the second P-type transistor MP2 is connected in series to the first P-type the transistor MP1, and the second P-type transistor MP2 outputs the current source IP1 to the first stacked diode-connected circuit.

The second output circuit comprises a third P-type transistor MP3 and a fourth P-type transistor MP4. The source of the third P-type transistor MP3 is connected to the operating voltage VDD, and the fourth P-type transistor MP4 is connected in series to the third P-type transistor MP3, and the fourth P-type transistor MP4 outputs the current source IP1 to the second stacked diode-connected circuit, and the gate of the fourth P-type transistor MP4 is connected to the gate of the second P-type transistor MP2.

The input circuit comprises a fifth P-type transistor MP5, a sixth P-type transistor MP6, a fifth N-type transistor MN5, and a sixth N-type transistor MN6. The drain of the fifth P-type transistor MP5 is connected to the operating voltage VDD, and the gate of the fifth P-type transistor MP5 is connected to the gate of the third P-type transistor MP3 and the gate of the first P-type transistor MP1.

The gate of the sixth P-type transistor MP6 is connected to the second feedback node F2, and the serial connection node of the sixth P-type transistor MP6 and the fifth P-type transistor MP5 is connected to the gate of the fifth P-type transistor MP5.

The gate of the fifth N-type transistor MN5 is connected to the gate of the fourth transistor MN4.

The gate of the sixth N-type transistor MN6 is connected to the first feedback node F1, and the serial connection node of the sixth N-type transistor MN6 and the fifth N-type transistor MN5 is connected to the third feedback node F3, and the third feedback node F3 is connected to the gate of the fourth P-type transistor MP4 and connected to the gate of the second P-type transistor MP2 (that is, there is a replicated feedback path that feeds back to the fourth P-type transistor MP4 and the second P-type transistor MP2), and the source of the sixth N-type transistor MN6 is connected to the ground GND. The path between connection node of the fifth N-type transistor MN5 and the sixth N-type transistor MN6, the gate of the second P-type transistor MP2, and the gate of the fourth P-type transistor MP4 is formed as an architecture of the feedback path. Similar, the path between the connection node of the first transistor MN1 and the second transistor MN2, and the gate of the sixth P-type transistor MP6 is also formed a feedback path.

In the above circuit architecture, the feedback of the self-biased voltage ensures the startup of the reference voltage generating circuit 10. When the power is turned on, the two points (A and B) in the low voltage state will quickly starts up the circuit, and then the voltage of B point will quickly decrease through the cross-coupling loop, thus avoiding the zero current state. In the design of the low power consumption reference voltage generating circuit 10, a traditional startup circuit will increase additional power consumption. The use of a cross-coupling loop not only eliminates the startup circuit, but also prevents the leakage current generated by the startup circuit from affecting the temperature coefficient performance of the circuit.

Based on the design in FIG. 1, the following reference voltage equation (3) can be obtained:

$$V_{REF} = \left(\frac{m_{N1}}{m_{N2}} V_{THN2} - V_{THN1}\right) + m_{N1} V_T \ln\left(\frac{2\mu_{N1} C_{oxN1} W_{N1} L_{N2}}{\mu_{N2} C_{oxN2} W_{N2} L_{N1}}\right) + \left(\frac{m_{N3}}{m_{N4}} V_{THN4} - V_{THN3}\right) + m_{N3} V_T \ln\left(\frac{\mu_{N3} C_{oxN3} W_{N3} L_{N4}}{\mu_{N4} C_{oxN4} W_{N4} L_{N3}}\right) \quad (3)$$

the parameters with subscripts N1, N2, N3, and N4 correspond to the first transistor MN1, the second transistor MN2, the third transistor MN3, and the fourth transistor MN4, respectively.

According to the above equation (3), a reference voltage independent of temperature can be obtained by adjusting the size of each transistor and the threshold voltage difference.

The power supply sensitivity is described below:

The suppression capability of the power supply variation is one of the decisive parameters for the performance of the reference voltage generating circuit. However, while reducing power consumption, it usually decreases the capability of suppressing the changes of the power supply.

Due to the influence of the slope parameter m, the sensitivity of the power supply is not zero, and the output resistance of the current source needs to be increased to increase the influence of the power supply change. Therefore, the above-mentioned stacked cascade current mirror architecture is used to increase the impedance value. The following describes the equation (4) of the power supply rejection ratio (power supply rejection ratio, PSRR):

$$\frac{V_{REF}}{V_{DD}} = \left(1 - \frac{g_{mb}}{g_{mt}}\right) \times \frac{\frac{1}{g_{mb}}}{R + \frac{1}{g_{mb}}} \text{ where } \left(g_m = \frac{I_D}{m \times V_T}\right) \quad (4)$$

the parameter $g_m$ is transconductance. In actual situations, the sizes of the two transistors have different designs for temperature compensation, it results in that the slope parameters m of the two transistors are different. That is, the parameter $g_{mt}$ of the first transistor MN1 will not be equal to the parameter $g_{mb}$ of the second transistor MN2, so that the power supply sensitivity is not zero under actual conditions.

It can select the slope parameters of the first transistor MN1 and the second transistor MN2. For example, the slope parameter of the first transistor MN1 is 90% of the slope parameter of the second transistor MN2. When the resistance of the above-mentioned current source is the same, the sensitivity of the power supply can be increased by 20 dB.

The following describes the improvement of the bandwidth of the power supply rejection ratio and the start-up time:

According to an embodiment of the present disclosure, the reference voltage generating circuit 10 further comprises a first coupling capacitor C1 and a second coupling capacitor C2, Two terminals of the first coupling capacitor C1 are respectively coupled between the gate of the fifth N-type transistor MN5 and a serial connection node of the fifth N-type transistor MN5 and the sixth P-type transistor MP6.

Two terminals of the second coupling capacitor C2 are respectively coupled between the serial connection node of the fifth N-type transistor MN5 and the sixth P-type transistor MP6 and the serial connection node of the first output circuit and the first stacked diode-connected circuit.

It can be seen from FIG. 1, between node C to node D and node E, the first coupled capacitor C1 and the second coupled capacitor C2 are added respectively. It can couple the rapid changing signal of the power supply voltage to the core circuit 200 so that the start-up time can be effectively shorten to less than 1 millisecond.

Figure 2:
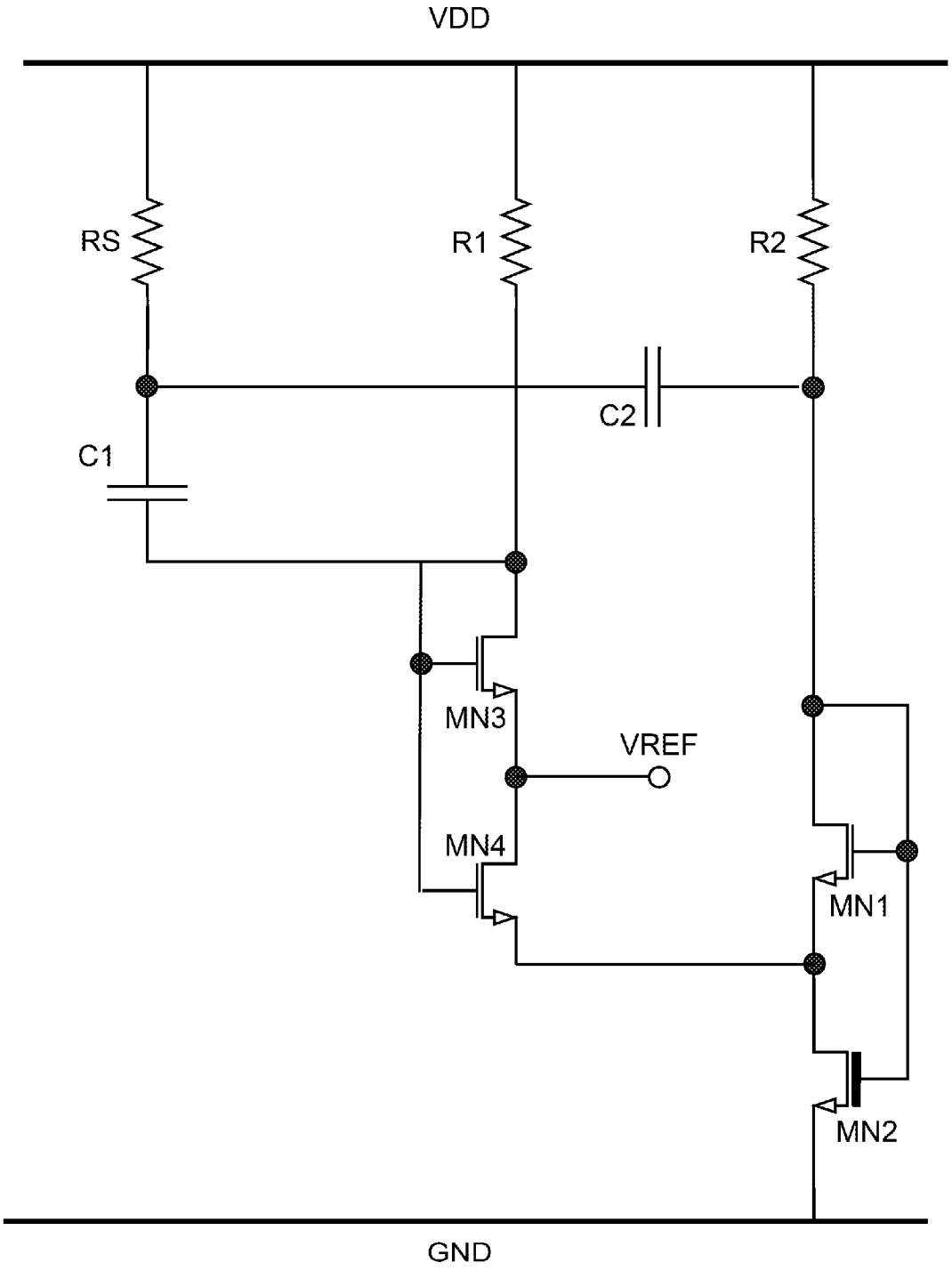
FIG. 2 is a simplified schematic diagram of a self-biased and capacitive-coupled reference voltage generating circuit according to an embodiment of the present disclosure.

Refer to FIG. 2, which is a simplified schematic diagram of a self-biased and capacitive-coupled reference voltage generating circuit according to an embodiment of the present disclosure. As shown in the drawings, the resistor RS in the current source circuit 100 corresponds to the fifth P-type transistor MP5 and the sixth P-type transistor MP6, and the resistor R1 corresponds to the third P-type transistor MP3 and the fourth P-type transistor, and the resistor R2 corresponds to the first P-type transistor MP1 and the second P-type transistor MP2, and C1 and C2 are equivalent capacitors corresponding to R1 and R2.

Next, from a more intuitive point of view, the first coupled capacitor C1 and the second coupled capacitor C2 respectively create leading and lagging paths from the power supply to VREF, and it can be seen from FIG. 2 that the paths are symmetrical and the attenuation of power disturbances is similar. Therefore, when the second coupled capacitor C2 changes with respect to the first coupled capacitor C1, the attenuation of the power disturbance is changed by the two capacitors, which affects the bandwidth of the power supply suppression ratio.

According to an embodiment of the present disclosure, the reference voltage generating circuit 10 further comprises a third coupled capacitor C3. Two terminals of the third coupled capacitor C3 are coupled between the gate of the fourth P-type transistor MP4 and the ground terminal GND. The high voltage terminal of the third coupled capacitor C3 is connected to the third feedback node F3, and coupled to the serial connection node of the sixth N-type transistor MN6 and the fifth N-type transistor MN5 through the third feedback node F3.

The addition of the aforementioned third coupled capacitor C3, for example, it can have 1.2 pico-farads (pF), which will effectively improve the stability of the transition voltage of node B after the reference voltage generating circuit 10 is activated.

According to an embodiment of the present disclosure, the capacitance value of the second coupled capacitor C2 is greater than the capacitance value of the first coupled capacitor C1. For example, the first coupled capacitor C1 is 45 femto-farads (fF), and the second coupled capacitor C2 is 450 femto-farads (fF).

The different capacitances between the first coupled capacitor C1 and the second coupled capacitor C2 causes a phase difference of attenuation of the power disturbance between the two capacitors, and the characteristic of notch is generated when the phase difference is 180 degrees. It extends the bandwidth of the power supply suppression ratio to 100 Hz, and suppresses interference from the 50 to 60 Hz frequency band of commercial power supplies.

According to an embodiment of the present disclosure, the third transistor MN3 and the fourth transistor MN4 have different sizes and threshold voltages. In this way, if it wants to output different reference voltages VREF under the same operating voltage VDD, only the threshold voltage and size of the first transistor MN1 and the second transistor MN2 need to be adjusted.

According to an embodiment of the present disclosure, the reference voltage generating circuit 10 does not comprise a bipolar junction transistor (i.e. lacking of the BJT). The circuit architecture disclosed by an embodiment of the present disclosure can be enabled by 180 nm CMOS process, and the total chip area is only 5900 square micrometers, and the power consumption is 1.8 nano-Watts. Therefore, the chip area and power consumption can be reduced.

Figure 3:
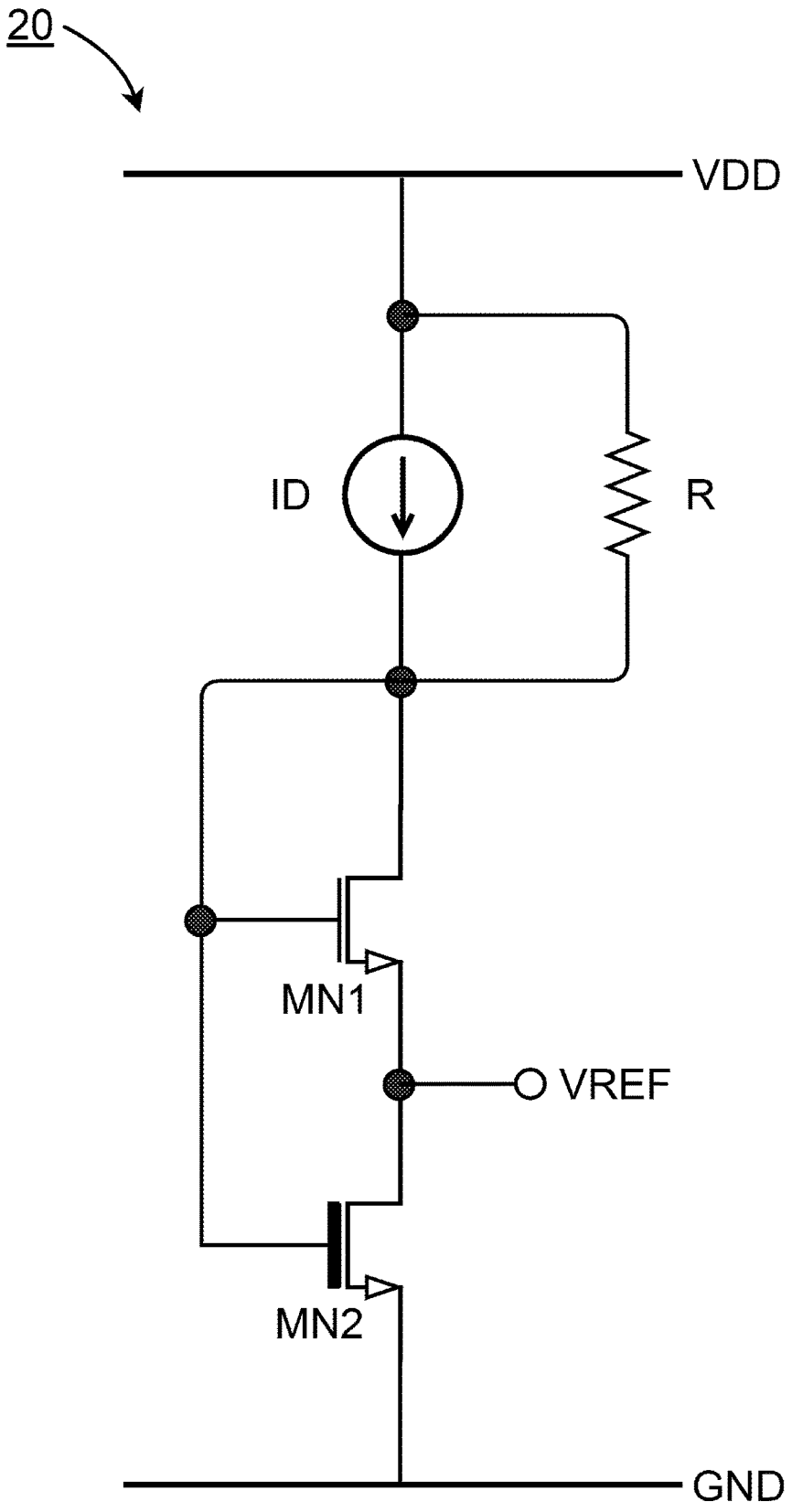
FIG. 3 is a schematic diagram of a reference voltage generating circuit with a stacked diode-connected architecture according to an embodiment of the present disclosure.

Refer to FIG. 3, which is a schematic diagram of a reference voltage generating circuit of a stacked diode-connected architecture according to an embodiment of the present disclosure. As shown in the drawings, an embodiment of the present disclosure also provides a reference voltage generating circuit 20 with a stacked diode-connected architecture, which comprises a current source circuit ID, a first transistor MN1 and a second transistor MN2. An input terminal of the current source circuit ID is connected to an operating voltage VDD, and the current source circuit ID outputs a current source.

The drain of the first transistor MN1 is connected to an output terminal of the current source circuit ID.

The second transistor MN2 is connected in series to the first transistor MN1, and the source of the second transistor MN2 is connected to the ground terminal GND, and the serial connection node of the second transistor MN2 and the first transistor MN1 outputs a reference voltage VREF, and the gates of the second transistor MN2 and the first transistor MN1 are connected to the output terminal of the current source circuit ID.

The above-mentioned reference voltage generating circuit 20 is a modification of an embodiment of the reference voltage generating circuit 10 and more simplified circuit architecture can be obtained.

According to an embodiment of the present disclosure, the first transistor MN1 and the second transistor MN2 are of the same type. Similar to the foregoing embodiments, when the temperature is changed, the threshold voltages of the same type of transistor are changed in the same direction, and the impact on the output voltage can be effectively reduced.

Figure 4:
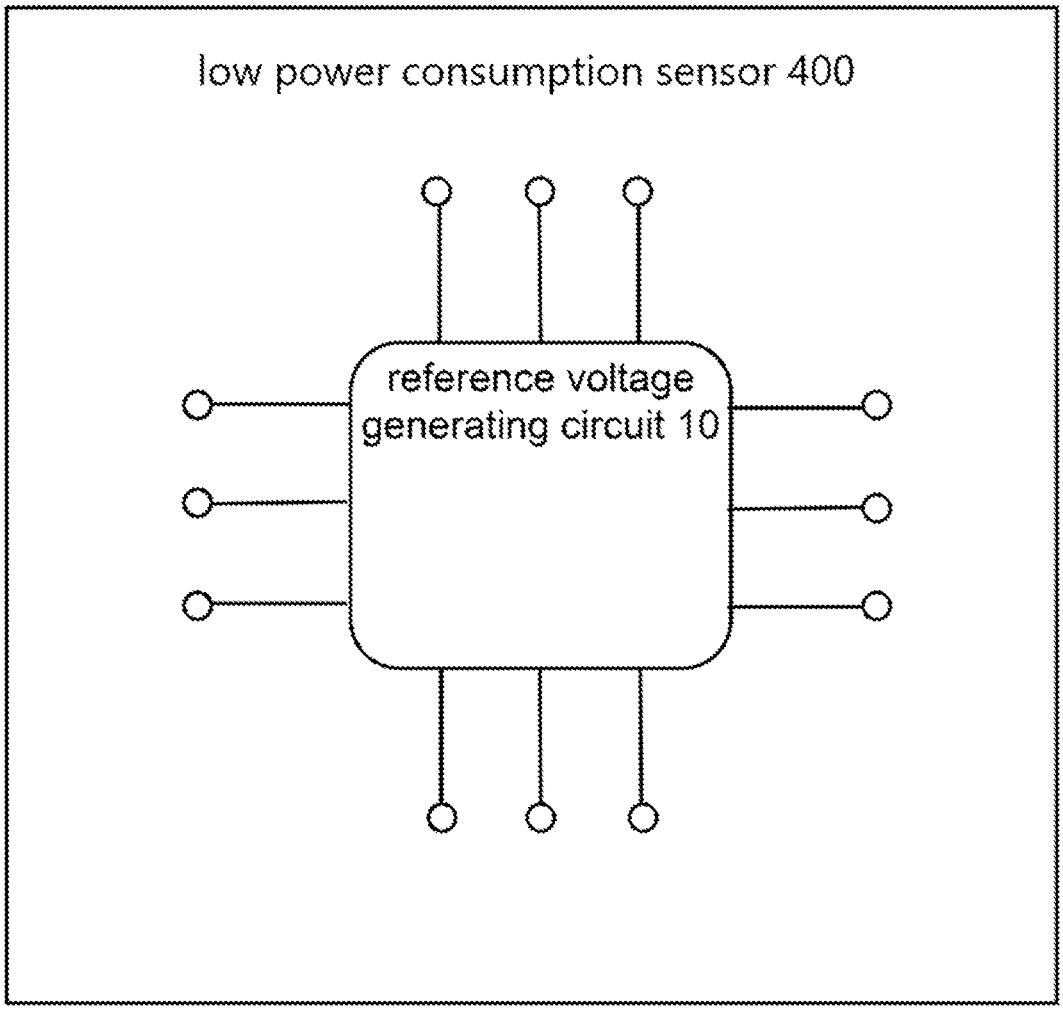
FIG. 4 is a schematic diagram of a low power consumption sensor comprising a self-biased and capacitive-coupled reference voltage generating circuit according to an embodiment of the present disclosure.

Refer to FIG. 4, which is a low power consumption sensor comprising a self-biased and capacitive-coupled reference voltage generating circuit according to an embodiment of the present disclosure. As shown in the drawings, an embodiment of the present disclosure also provides a low power consumption sensor 400, which is suitable for battery-less IoT devices. The low power consumption sensor comprises the reference voltage generating circuit 10 or 20 described above.

According to an embodiment of the present disclosure, the low power consumption sensor may be a patch sensor or a biomedical implanter. Such sensors or implanters are mostly battery-less application devices, which require low power consumption, small area, and calibration-free reference voltage generating circuits 10 or 20 provided from an embodiments of the present disclosure.

The above description is only exemplary, not restrictive. Any equivalent modification or alteration that does not deviate from the spirit and scope of the present disclosure shall be included in the scope of the appended patent application claims.

What is claimed is:

1. A self-biased and capacitive-coupled reference voltage generating circuit, comprising:

a current source circuit, an input terminal of the current source circuit is connected to a first feedback node, a voltage of the first feedback node is a reference voltage, and a plurality of output terminals of the current source circuit output current sources;

a core circuit, comprising:

a first stacked diode-connected circuit, having a first transistor with a diode-connected configuration and a second transistor having a conductive type same as that of the first transistor, wherein a connection node of the first transistor and the second transistor outputs a threshold voltage difference value, wherein the input terminal of the first stacked diode-connected circuit, the gates of the first transistor and the second transistor are connected to one of the output terminals of the current source circuit, wherein the output terminal of the second transistor is connected to a ground terminal; and a second stacked diode-connected circuit, having a third transistor with a diode-connected configuration and a fourth transistor having a conductive type same as that of the third transistor, wherein a connection node of the third transistor and the fourth transistor outputs the reference voltage, wherein the input terminal of the second stacked diode-connected circuit, the gates of the third transistor and the fourth transistor are connected to another one of the output terminals of the current source circuit, wherein a second feedback node is formed between the output terminal of the fourth transistor and the input terminal of the current source circuit.

2. The reference voltage generating circuit of claim 1, wherein the current source circuit comprises a cascode current mirror circuit.

3. The reference voltage generating circuit of claim 2, wherein the cascade current mirror circuit comprises:

a first output circuit, comprising:

a first P-type transistor, a source of the first P-type transistor is connected to an operating voltage; and a second P-type transistor, connected to the first P-type transistor in series, and the second P-type transistor outputs the current source to the first stacked diode-connected circuit;

a second output circuit, comprising:

a third P-type transistor, a source of the third P-type transistor is connected to the operating voltage; and a fourth P-type transistor, connected to the third P-type transistor in series, and the fourth P-type transistor outputs the current source to the second stacked diode-connected circuit, and a gate of the fourth P-type transistor is connected to a gate of the second P-type transistor; and an input circuit, comprising:

a fifth P-type transistor, a source of the fifth P-type transistor is connected to the operating voltage, and a gate of the fifth P-type transistor is connected to a gate of the third P-type transistor and a gate of the first P-type transistor;

a sixth P-type transistor, a gate of the sixth P-type transistor is connected to the second feedback node, and a serial connection node of the sixth P-type transistor and the fifth P-type transistor is connected to the gate of the fifth P-type transistor;

a fifth N-type transistor, a gate of the fifth N-type transistor is connected to the gate of the fourth transistor; and a sixth N-type transistor, a gate of the sixth N-type transistor is connected to the first feedback node, and a serial connection node of the sixth N-type transistor and the fifth N-type transistor is connected to a third feedback nodes, and the third feedback node is connected to the gates of the fourth P-type transistor and the second P-type transistor, and a source of the sixth N-type transistor is connect to the ground terminal.

4. The reference voltage generating circuit of claim 3, further comprising:

a first coupling capacitor, two terminals of the first coupling capacitor are coupled between the gate of the fifth N-type transistor and the serial connection node of the fifth N-type transistor and the sixth P-type transistor; and a second coupling capacitor, a terminal of the second coupling capacitor is coupled to a serial connection node of the fifth N-type transistor and the sixth P-type transistor, and another terminal of the second coupling capacitor is coupled between the first output circuit and the first stacked diode-connected circuit.

5. The reference voltage generating circuit of claim 4, further comprising:

a third coupling capacitor, a terminal of the third coupling capacitor is coupled to the gates of the fourth P-type transistor and the second P-type transistor, and another terminal of the third coupling capacitor is coupled to the ground terminal, and a high voltage terminal of the two terminals of the third coupling capacitor is coupled to the third feedback node, and the high voltage terminal of the third coupling capacitor is connected to a serial connection node of the sixth N-type transistor and the fifth N-type transistor through the third feedback node.

6. The reference voltage generating circuit of claim 4, wherein a capacitance value of the second coupling capacitor is greater than a capacitance value of the first coupling capacitor.

7. The reference voltage generating circuit of claim 1, wherein a size and a threshold voltage of the third transistor are respectively different from those of the fourth transistor.

8. The reference voltage generating circuit of claim 1, wherein the reference voltage generating circuit lacks of a bipolar junction transistor.

9. A low-power consumption sensor, suitable for battery-less Internet of Things devices, wherein the low-power consumption sensor comprising the reference voltage generating circuit of claim 1.

10. The low-power consumption sensor of claim 9, wherein the low-power consumption sensor is a patch-type sensor or a biomedical implanter.

11. The low-power consumption sensor of claim 9, wherein the current source circuit comprises a cascode current mirror circuit.

12. The low-power consumption sensor of claim 11, wherein the cascade current mirror circuit comprises:

a first output circuit, comprising:

a first P-type transistor, a source of the first P-type transistor is connected to an operating voltage; and a second P-type transistor, connected to the first P-type transistor in series, and the second P-type transistor outputs the a first current source of the current sources to the first stacked diode-connected circuit;

a second output circuit, comprising:

a third P-type transistor, a source of the third P-type transistor is connected to the operating voltage; and a fourth P-type transistor, connected to the third P-type transistor in series, and the fourth P-type transistor outputs a second current source of the current sources to the second stacked diode-connected circuit, and a gate of the fourth P-type transistor is connected to a gate of the second P-type transistor; and an input circuit, comprising:

a fifth P-type transistor, a source of the fifth P-type transistor is connected to the operating voltage, and a gate of the fifth P-type transistor is connected to a gate of the third P-type transistor and a gate of the first P-type transistor;

a sixth P-type transistor, a gate of the sixth P-type transistor is connected to the second feedback node, and a serial connection node of the sixth P-type transistor and the fifth P-type transistor is connected to the gate of the fifth P-type transistor;

a fifth N-type transistor, a gate of the fifth N-type transistor is connected to the gate of the fourth transistor; and a sixth N-type transistor, a gate of the sixth N-type transistor is connected to the first feedback node, and a serial connection node of the sixth N-type transistor and the fifth N-type transistor is connected to a third feedback nodes, and the third feedback node is connected to the gates of the fourth P-type transistor and the second P-type transistor, and a source of the sixth N-type transistor is connect to the ground terminal.

13. The low-power consumption sensor of claim 12, wherein the reference voltage generating circuit further comprises:

a first coupling capacitor, two terminals of the first coupling capacitor are coupled between the gate of the fifth N-type transistor and the serial connection node of the fifth N-type transistor and the sixth P-type transistor; and a second coupling capacitor, a terminal of the second coupling capacitor is coupled to a serial connection node of the fifth N-type transistor and the sixth P-type transistor, and another terminal of the second coupling capacitor is coupled between the first output circuit and the first stacked diode-connected circuit.

14. The low-power consumption sensor of claim 13, wherein the reference voltage generating circuit further comprises:

a third coupling capacitor, a terminal of the third coupling capacitor is coupled to the gates of the fourth P-type transistor and the second P-type transistor, and another terminal of the third coupling capacitor is coupled to the ground terminal, and a high voltage terminal the two terminals of the third coupling capacitor is coupled to the third feedback node, and the high voltage terminal of the third coupling capacitor is connected to a serial connection node of the sixth N-type transistor and the fifth N-type transistor through the third feedback node.

15. The low-power consumption sensor of claim 13, wherein a capacitance value of the second coupling capacitor is greater than a capacitance value of the first coupling capacitor.

16. The low-power consumption sensor of claim 9, wherein a size and a threshold voltage of the third transistor are respectively different from those of the fourth transistor.

17. The low-power consumption sensor of claim 9, wherein the reference voltage generating circuit lacks of a bipolar junction transistor.

18. A reference voltage generating circuit with a stacked diode-connected architecture, comprising:

a current source circuit, an input terminal of the current source circuit is connected to an operating voltage, and the current source circuit outputs a current source;

a first transistor, a drain of the first transistor is connected to the output terminal of the current source circuit; and a second transistor, connected to the first transistor in series, and a source of the second transistor is connected to a ground terminal, wherein a serial connection node of the second transistor and the first transistor outputs a reference voltage, and a gate of the second transistor and a gate of the first transistor are connected to the output terminal of the current source circuit, wherein a thickness of a gate oxide layer of the first transistor is smaller than a thickness of a gate oxide layer of the second transistor.

19. The reference voltage generating circuit of claim 18, wherein the first transistor and the second transistor are a same conductive type.

* * * * *